US010010186B2

(12) United States Patent
Yang

(10) Patent No.: US 10,010,186 B2
(45) Date of Patent: Jul. 3, 2018

(54) FOLDING BED

(71) Applicant: TOPSUN CREATIVE DESIGN, Hangzhou, Zhejiang (CN)

(72) Inventor: Baoqing Yang, Zhejiang (CN)

(73) Assignee: TOPSUN CREATIVE DESIGN, Hangzhou, Zhejiang (CN)

( * ) Notice: Subject to any disclaimer, the term of this patent is extended or adjusted under 35 U.S.C. 154(b) by 2 days.

(21) Appl. No.: 15/122,777

(22) PCT Filed: Jul. 11, 2014

(86) PCT No.: PCT/CN2014/082044
§ 371 (c)(1),
(2) Date: Aug. 31, 2016

(87) PCT Pub. No.: WO2015/149442
PCT Pub. Date: Oct. 8, 2015

(65) Prior Publication Data

US 2017/0065090 A1 Mar. 9, 2017

(30) Foreign Application Priority Data

Apr. 3, 2014 (CN) ..... 2014 1 0134674
Apr. 3, 2014 (CN) ..... 2014 2 0162245 U

(51) Int. Cl.
*A47C 17/68* (2006.01)
*A47C 17/64* (2006.01)
*A47C 17/70* (2006.01)

(52) U.S. Cl.
CPC ..... *A47C 17/68* (2013.01); *A47C 17/645* (2013.01); *A47C 17/705* (2013.01)

(58) Field of Classification Search
CPC ..... A47C 17/74; A47C 17/68; A47C 17/64
See application file for complete search history.

(56) References Cited

U.S. PATENT DOCUMENTS 229,421 A * 6/1880 Joslin ..... A47C 17/68 5/111
2,534,019 A * 12/1950 Griswold ..... A47C 17/68 482/28

(Continued)

FOREIGN PATENT DOCUMENTS

CN 2071604 U 2/1991
CN 1136648 A 11/1996

(Continued)

OTHER PUBLICATIONS

International Search Report for PCT/CN2014/082044, dated Dec. 1, 2014, ISA/CN.

(Continued)

*Primary Examiner* — Eric J Kurilla
(74) *Attorney, Agent, or Firm* — U.S. Fairsky LLP; Yue Xu

(57) ABSTRACT

A folding bed is provided, which includes a bed sheet, a first lateral supporting rod connected to a first edge of the bed sheet and a second side supporting rod connected to a second edge of the bed sheet. The folding bed further includes a first L-shaped supporting rod having a first end articulated to the first side supporting rod, a second L-shaped support rod having a first end articulated to the second side supporting rod, a gear connected to a second end of the first L-shaped supporting rod, and a gear locking member connected to a second end of the second L-shaped supporting rod. The gear locking member is provided with teeth which are rotatable in only one direction with respect to teeth of the gear. The folding bed is has a small size after being folded, is convenient to assemble and is easy to fold.

10 Claims, 6 Drawing Sheets

(56) References Cited

U.S. PATENT DOCUMENTS

| | | | | | |
|---|---|---|---|---|---|
| 3,956,781 | A * | 5/1976 | Reemelin | A47C 17/705 | 5/110 |
| 4,012,800 | A * | 3/1977 | Mitchell | A23B 7/148 | 5/187 |
| 4,219,896 | A * | 9/1980 | Behel | A47C 17/70 | 5/110 |
| 5,246,265 | A | 9/1993 | Nagan et al. | | |
| 5,542,151 | A * | 8/1996 | Stranski | A47D 13/063 | 16/326 |
| D744,269 | S * | 12/2015 | Lah | D6/709.2 | |
| 2014/0115780 | A1* | 5/2014 | Lah | A47C 19/12 | 5/111 |

FOREIGN PATENT DOCUMENTS

| | | | |
|---|---|---|---|
| CN | 2330241 | Y | 7/1999 |
| CN | 2374081 | Y | 4/2000 |
| CN | 201108202 | Y | 9/2008 |
| CN | 201894404 | U | 7/2011 |
| CN | 103222752 | A | 7/2013 |
| CN | 203468091 | U | 3/2014 |
| EP | 1425994 | A1 | 6/2004 |
| TW | 201340912 | A | 10/2013 |

OTHER PUBLICATIONS

Summary of the Chinese 2nd Office Action for CN201410134674.0, dated May 31, 2017.
Summary of the Chinese 1st Office Action for CN201410134674.0, dated Jan. 18, 2017.

* cited by examiner

FOLDING BED

The present application is the national phase of International Application No. PCT/CN2014/082044, titled "FOLDING BED", filed on Jul. 11, 2014 which claims the benefit of priority to Chinese patent application No. 201410134674.0 titled "FOLDING BED", filed with the Chinese State Intellectual Property Office on Apr. 3, 2014, the entire disclosure of which application is incorporated herein by reference.

The present application is the national phase of International Application No. PCT/CN2014/082044, titled "FOLDING BED", filed on Jul. 11, 2014 which claims the benefit of priority to Chinese patent application No. 201420162245.X titled "FOLDING BED", filed with the Chinese State Intellectual Property Office on Apr. 3, 2014, the entire disclosure of which application is incorporated herein by reference.

FIELD

The present application relates to the technical field of articles of daily use, and more specifically to a folding bed.

BACKGROUND

Having the advantages of being foldable and convenient for carrying and transporting, folding beds have become a first choice in outdoor leisure products. However, most of the folding beds have the defects of a large volume after being folded, a cumbersome assembly, and a difficult folding, which brings inconvenience to people's life.

Therefore, a critical issue urgently to be addressed by those skilled in the art is to design a folding bed which has a small volume after being folded, is convenient to assemble and is easy to fold.

SUMMARY

An object of the present application is to provide a folding bed which has a small volume after being folded, is convenient to assemble and is easy to fold.

For achieving the above object, technical solutions are provided by the present application as follows.

The folding bed includes:

a bed sheet, a first side supporting rod connected to a first edge of the bed sheet, and a second side supporting rod connected to a second edge of the bed sheet, the first edge being opposite to the second edge.

The folding bed further includes:

- a first L-shaped supporting rod having a first end articulated to the first side supporting rod,
- a second L-shaped supporting rod having a first end articulated to the second side supporting rod,
- a gear connected to a second end of the first L-shaped supporting rod, and
- a gear locking member connected to a second end of the second L-shaped supporting rod.

The gear locking member has teeth, and the teeth of the gear locking member and teeth of the gear are locked by each other in the case that the second end of the first L-shaped supporting rod and the second end of the second L-shaped supporting rod rotate away from the bed sheet, and relatively slide in the case that the second end of the first L-shaped supporting rod and the second end of the second L-shaped supporting rod rotate close to the bed sheet.

Preferably, the folding bed further includes a gear fixing member, the gear is located in the gear fixing member and is circumferentially fixed and is movable in the axial direction, a compressed spring is arranged between the gear and the gear locking member, the teeth of the gear are arranged on an end surface of the gear and are in a circumferential direction of the gear, and each of the teeth of the gear includes a first locking tooth surface and a first slidable tooth surface; and the gear locking member and the gear fixing member are axially connected, the teeth of the gear locking member are arranged on an end surface of the gear locking member and are in a circumferential direction of the gear locking member, each of the teeth of the gear locking member includes a second locking tooth surface which fits and locks the first locking tooth surface and a second slidable tooth surface which fits the first slidable tooth surface and slides with respect to the first slidable tooth surface.

Preferably, a position-limiting groove is provided in an inner surface of the gear fixing member, and an outer circumferential surface of the gear is provided with a position-limiting protrusion which fits the position-limiting groove.

Preferably, the first locking tooth surface is a tooth surface having 90 degrees, the first slidable tooth surface is a tooth surface having 45 degrees, the second locking tooth surface is a tooth surface having 90 degrees, and the second slidable tooth surface is a tooth surface having 45 degrees.

Preferably, the folding bed further includes a rivet, a first rivet hole which fits the rivet is arranged on the gear fixing member, and a second rivet hole which fits the rivet is arranged on the gear locking member.

Preferably, the folding bed further includes a button configured to press the gear toward the gear fixing member to allow the gear to disengage from the gear locking member.

Preferably, the button further includes a button surface located at an outside of the gear locking member, and a presser foot which is connected to the button surface and configured to press the gear; and the gear locking member is provided with a presser foot hole which fits the presser foot, and a bottom of the presser foot is provided with a presser foot protrusion which prevents the presser foot from penetrating through the presser foot hole.

Preferably, the gear fixing member includes a first connecting pipe and one end of the first L-shaped supporting rod is inserted into the first connecting pipe.

Preferably, the gear locking member includes a second connecting pipe, and one end of the second L-shaped supporting rod is inserted into the second connecting pipe.

Preferably, the first end of the first L-shaped supporting rod is provided with a first C-shaped clamping element for clamping the first side supporting rod, and the first end of the second L-shaped supporting rod is provided with a second C-shaped clamping element for clamping the second side supporting rod.

It could be seen from the above technical solutions that, during assembly of the folding bed, the first end of the first L-shaped supporting rod is articulated to the first side supporting rod, the first end of the second L-shaped supporting rod is articulated to the second side supporting rod, the second end of the first L-shaped supporting rod and the second end of the second L-shaped supporting rod rotate in a direction that is close to the bed sheet, a distance between the first end of the first L-shaped supporting rod and the first end of the second L-shaped supporting rod becomes larger and larger till the bed sheet is tightly stretched, and thus the assembly of the folding bed is completed. During folding of the folding bed, the first side supporting rod is disassembled from the first L-shaped supporting rod, the second side supporting rod is disassembled from the second L-shaped supporting rod, and then the second end of the first L-shaped supporting rod or the second end of the second L-shaped supporting rod continues to rotate in a direction that is close to the bed sheet till the first L-shaped supporting rod and the second L-shaped supporting rod are folded together, and thus the folding of the folding bed is completed. The folding bed provided by the present application has a small volume after being folded, is convenient to assemble and is easy to fold.

Figure 1:
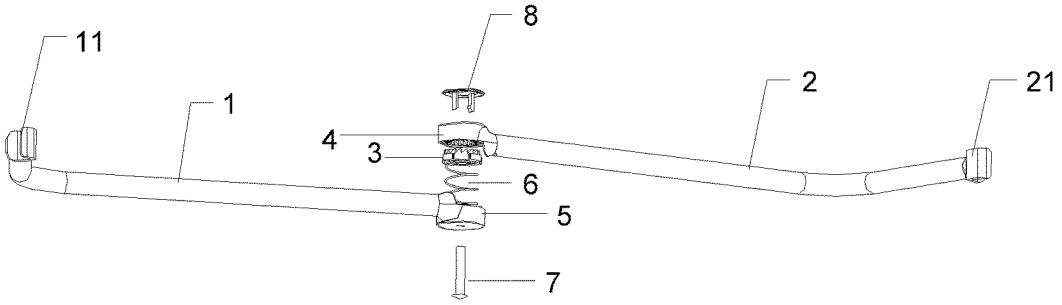
FIG. 1 is an exploded view showing a first L-shaped supporting rod, a second L-shaped supporting rod, a gear locking member, a gear, a compressed spring, a gear fixing member and a button according to an embodiment of the present application.

Reference Numerals:

| | | | |
|---|---|---|---|
| 1 | first L-shaped supporting rod, | 11 | first C-shaped clamping element, |
| 2 | second L-shaped supporting rod, | 21 | second C-shaped clamping element, |
| 10 | first side supporting rod, | 20 | second side supporting rod, |
| 3 | gear, | 31 | first slidable tooth surface, |
| 32 | first locking tooth surface, | 33 | position-limiting protrusion, |
| 4 | gear locking member, | 41 | second rivet hole, |
| 42 | presser foot hole, | 43 | second connecting pipe, |
| 5 | gear fixing member, | 51 | first rivet hole, |
| 53 | first connecting pipe, | 6 | compressed spring, |
| 7 | rivet, | 8 | button, |
| 81 | button surface, | 82 | presser foot, |
| 83 | presser foot protrusion, and | 9 | bed sheet. |

DETAILED DESCRIPTION

A folding bed is provided according to the present application, which has a small volume after being folded, is convenient to assemble and is easy to fold.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the protection scope of the present application.

Figure 2:
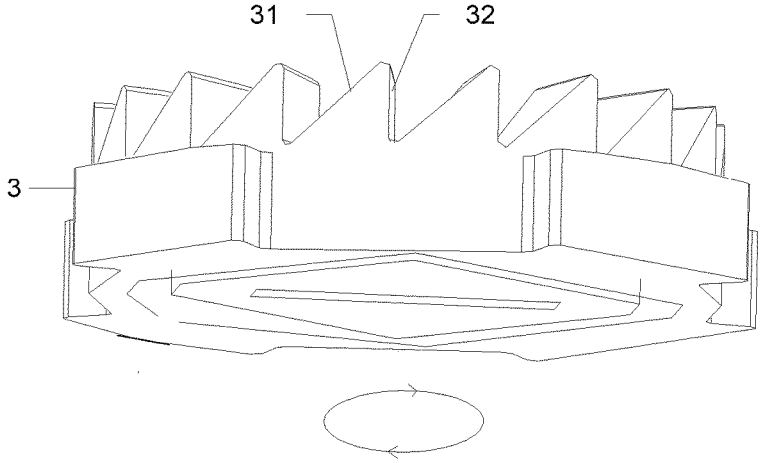
FIG. 2 is a schematic view showing the structure of the gear according to an embodiment of the present application.
Figure 3:
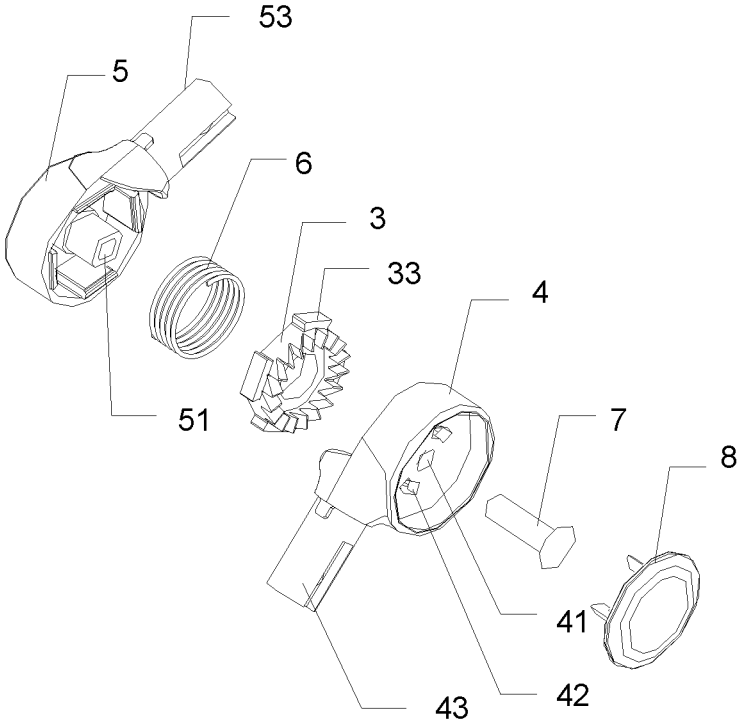
FIG. 3 is an exploded view showing the gear fixing member, the compressed spring, the gear, the gear locking member, a rivet and the button according to an embodiment of the present application.
Figure 4:
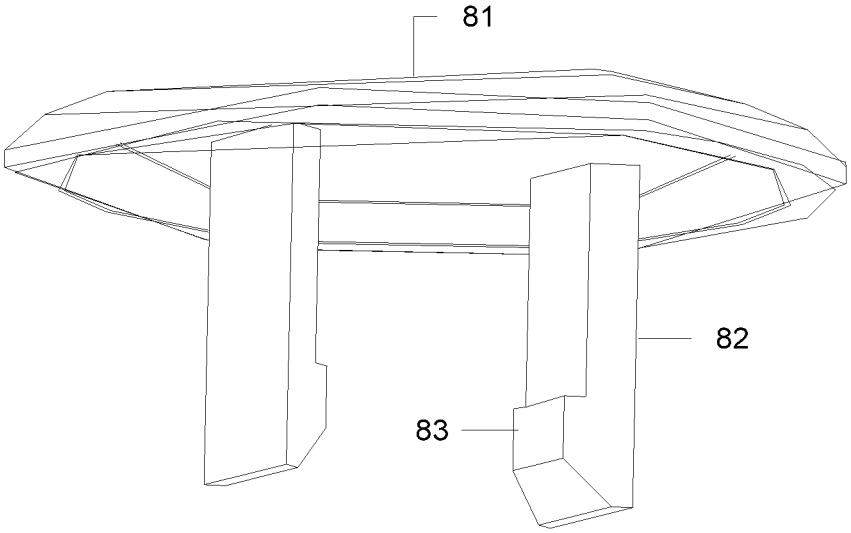
FIG. 4 is a schematic view showing the structure of the button according to an embodiment of the present application.
Figure 5:
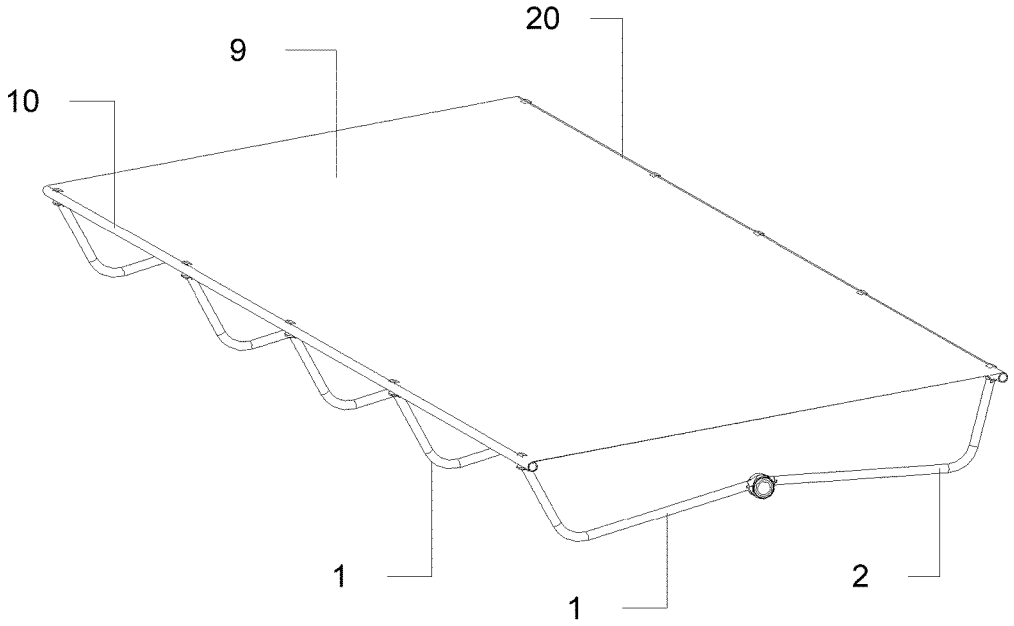
FIG. 5 is a view showing a folding bed in using state according to an embodiment of the present application.
Figure 6:
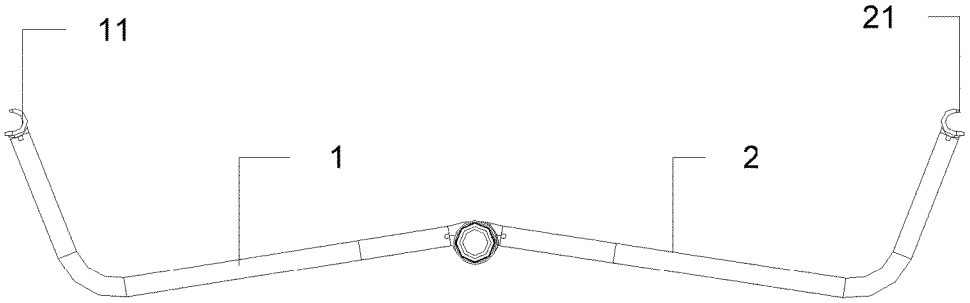
FIG. 6 is a schematic view showing the first L-shaped supporting rod and the second L-shaped supporting rod when a bed sheet is tightly stretched according to an embodiment of the present application.
Figure 7:
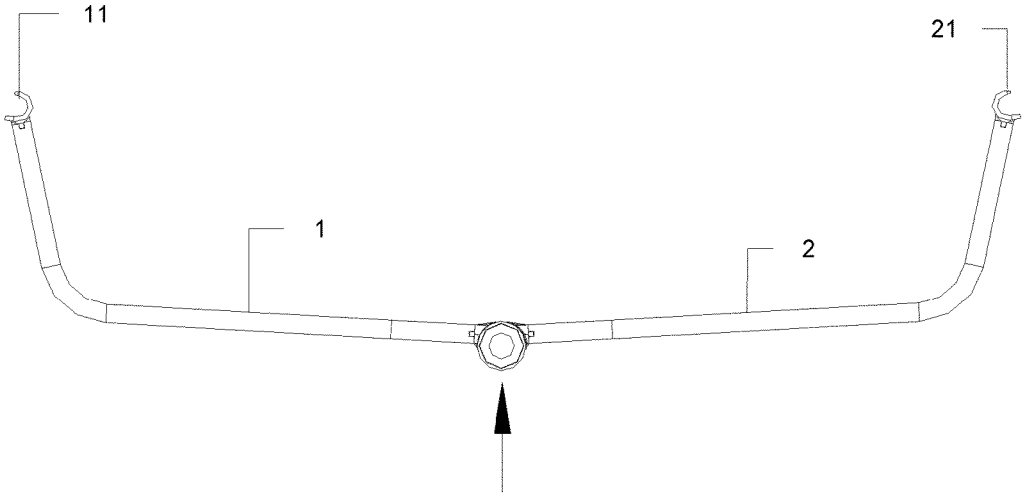
FIG. 7 is a schematic view showing the first L-shaped supporting rod and the second L-shaped supporting rod when the bed sheet is loosened according to an embodiment of the present application.
Figure 8:
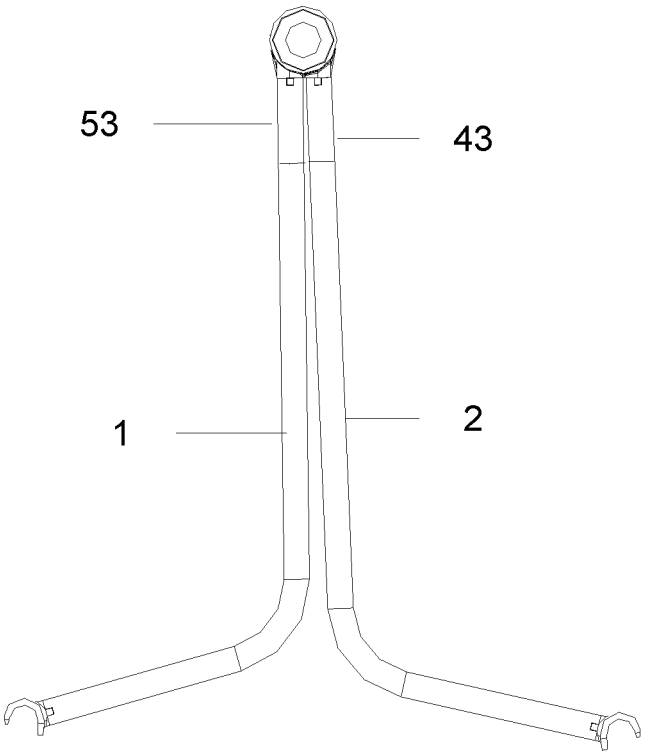
FIG. 8 is a schematic view showing the structure of the first L-shaped supporting rod and the second L-shaped supporting rod in a folded state according to an embodiment of the present application.
Figure 9:
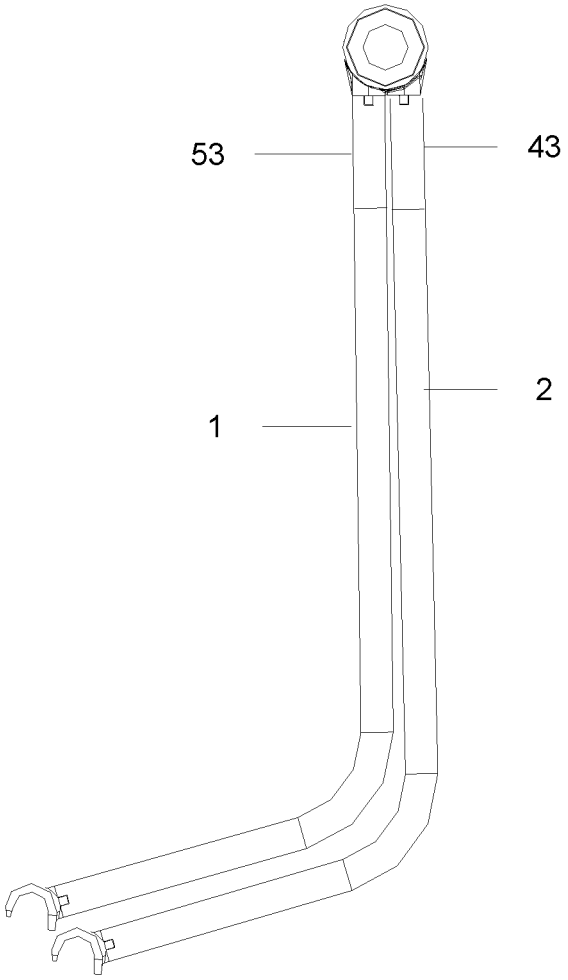
FIG. 9 is a schematic view showing the structure of the first L-shaped supporting rod and the second L-shaped supporting rod in a completely folded state according to an embodiment of the present application.

Reference is made to FIGS. 1 to 9. FIG. 1 is an exploded view showing a first L-shaped supporting rod, a second L-shaped supporting rod, a gear locking member, a gear, a compressed spring, a gear fixing member and a button according to an embodiment of the present application. FIG. 2 is a schematic view showing the structure of the gear according to an embodiment of the present application. FIG. 3 is an exploded view showing the gear fixing member, the compressed spring, the gear, the gear locking member, a rivet and the button according to an embodiment of the present application. FIG. 4 is a schematic view showing the structure of the button according to an embodiment of the present application. FIG. 5 is a view showing a folding bed in using state according to an embodiment of the present application. FIG. 6 is a schematic view showing the first L-shaped supporting rod and the second L-shaped supporting rod when a bed sheet according to an embodiment of the present application is tightly stretched. FIG. 7 is a schematic view showing the first L-shaped supporting rod and the second L-shaped supporting rod when the bed sheet according to an embodiment of the present application is loosened. FIG. 8 is a schematic view showing the structure of the first L-shaped supporting rod and the second L-shaped supporting rod in a folded state according to an embodiment of the present application. FIG. 9 is a schematic view showing the structure of the first L-shaped supporting rod and the second L-shaped supporting rod in completely folded state according to an embodiment of the present application.

In one embodiment of the present application, a folding bed includes a bed sheet 9, a first side supporting rod 10, a second side supporting rod 20, and further includes a first L-shaped supporting rod 1, a second L-shaped supporting rod 2, a gear 3 and a gear locking member 4.

The first side supporting rod 10 is connected to one edge of the bed sheet 9, the second side supporting rod 20 is connected to another edge of the bed sheet 9, and a first edge and a second edge are two opposite edges of the bed sheet 9. The first L-shaped supporting rod 1 has a first end articulated to the first side supporting rod 10, and a second end connected to the gear 3, that is, an end portion of a "|" structure of the first L-shaped supporting rod 1 is articulated to the first side supporting rod 10, and an end portion of a "_" structure of the first L-shaped supporting rod 1 is connected to the gear 3. The second L-shaped supporting rod 2 has a first end articulated to the second side supporting rod 20, and a second end connected to the gear locking member 4, that is, an end portion of a "|" structure of the second L-shaped supporting rod 2 is articulated to the second side supporting rod 20, and an end portion of a "_" structure of the second L-shaped supporting rod 2 is connected to the gear locking member 4.

The gear locking member 4 has teeth which are slidable in a forward direction and are locked in a reverse direction relative to teeth of the gear 3, namely, the gear locking member 4 or the gear 3 is only rotatable in one direction, and is locked and not allowed to rotate in a reverse direction. In this embodiment, when the second end of the first L-shaped supporting rod 1 which is connected to the gear 3, and the second end of the second L-shaped supporting rod 2 which is connected to the gear locking member 4, rotate close to the bed sheet 9, the gear 3 slides relative to the gear locking member 4, that is, the rotation between the first L-shaped supporting rod 1 and the second L-shaped supporting rod 2 is allowed. When the second end of the first L-shaped supporting rod 1 and the second end of the second L-shaped supporting rod 2 rotate away from the bed sheet 9, the rotation of the first L-shaped supporting rod 1 and the second L-shaped supporting rod 2 is prevented due to mutual locking between the teeth of the gear 3 and the teeth of the gear locking member 4.

During assembly of the folding bed, the first end of the first L-shaped supporting rod 1 is articulated to the first side supporting rod 10, the first end of the second L-shaped supporting rod 2 is articulated to the second side supporting rod 20, and the second end of the first L-shaped supporting rod 1 and the second end of the second L-shaped supporting rod 2 rotate towards a direction that is close to the bed sheet 9. As shown in FIG. 7, a force in a direction indicated by the arrow is applied, a distance between the first end of the first L-shaped supporting rod 1 and the first end of the second L-shaped supporting rod 2 becomes larger and larger till the bed sheet 9 is tightly stretched, thus, the assembly of the folding bed is completed. As shown in FIG. 5, after the bed sheet 9 is tightly stretched, because of the existence of a tight stretching force, the second end of the first L-shaped supporting rod 1 and the second end of the second L-shaped supporting rod 2 do not tend to continually rotate in a direction close to the bed sheet 9 and only tend to rotate away from the bed sheet 9. However, due to the locking effect between a first locking tooth surface 32 and a second locking tooth surface, the first L-shaped supporting rod 1 and the second L-shaped supporting rod 2 are not rotatable in the reverse direction, thus ensuring the stability of the folding bed in use.

When the folding bed is folded, the first side supporting rod 10 is disassembled from the first L-shaped supporting rod 1, the second side supporting rod 20 is disassembled from the second L-shaped supporting rod 2, and then the second end of the first L-shaped supporting rod 1 or the second end of the second L-shaped supporting rod 2 continues to rotate in the direction close to the bed sheet 9 till the first L-shaped supporting rod 1 and the second L-shaped supporting rod 2 are folded together, thus achieving folding of the folding bed. The folding bed according to the present application has a small volume after being folded, is convenient to assemble and is easy to fold.

According to an embodiment of the present application, a gear fixing member 5 and a compressed spring 6 are further included. The gear 3 is located in the gear fixing member 5 and is circumferentially fixed and is axially movable. The compressed spring 6 is arranged between the gear 3 and the gear locking member 4. The gear fixing member 5 and the gear locking member 4 are axially connected, that is, the gear fixing member 5 and the gear locking member 4 are relatively fixed in the axial direction. The teeth of the gear 3 are arranged on an end surface of the gear 3, and each of the teeth of the gear 3 includes a first locking tooth surface 32 and a first slidable tooth surface 31 in a circumferential direction of the gear 3. The teeth of the gear locking member 4 are also arranged on an end surface of the gear locking member 4, and each of the teeth of the gear locking member 4 has a second locking tooth surface and a second slidable tooth surface in a circumferential direction of the gear locking member 4. The first locking tooth surface 32 of the gear 3 and the second locking tooth surface of the gear locking member 4 fit together, and the first slidable tooth surface 31 and the second slidable tooth surface of the gear locking member 4 fit together.

When the second end of the first L-shaped supporting rod 1 and the second end of the second L-shaped supporting rod 2 rotate in the direction close to the bed sheet 9, the first slidable tooth surface 31 and the second slidable tooth surface overcome a friction force between themselves and slide relatively. During the sliding, under a pressing effect of the second slidable tooth surface, the gear 3 presses the compressed spring 6 and moves in a direction close to the gear fixing member 5, so as to ensure that the first slidable tooth surface 31 disengages from the second slidable tooth surface, and each of the teeth of the gear 3 enters a next tooth of the gear locking member 4.

When the first L-shaped supporting rod 1 and the second L-shaped supporting rod 2 tend to rotate away from the bed sheet 9, the first locking tooth surface 32 of the gear 3 and the second locking tooth surface of the gear locking member 4 press each other. However, the first locking tooth surface 32 and the second locking tooth surface cannot slide relatively due to the mutual locking between themselves. Therefore, the rotation between the first L-shaped supporting rod 1 and the second L-shaped supporting rod 2 is prevented.

In this embodiment, rotation in the forward direction and locking in the reverse direction of the gear 3 or the gear locking member 5 are realized by tactfully using the compressed spring 6, the locking tooth surface and the slidable tooth surface.

In an embodiment of the present application, a position-limiting groove is provided in an inner surface of the gear fixing member 5, and an outer circumferential surface of the gear 3 is provided with a position-limiting protrusion 33 which matches with the position-limiting groove. Thus, when the position-limiting protrusion 33 of the gear 3 is stuck in the position-limiting groove of the gear fixing member 5, circumferential positioning of the gear 3 with respect to the gear fixing member 5 is realized. Of course, for ensuring a position-limiting reliability, multiple position-limiting grooves, for example two, three, or four, may be provided in the inner surface of the gear fixing member 5 in a circumferential direction of the gear fixing member 5. Correspondingly, the outer circumferential surface of the gear 3 is provided with multiple position-limiting protrusions.

Preferably, in an embodiment of the present application, the first locking tooth surface 32 of the gear 3 is a tooth surface having 90 degrees, and the first slidable tooth surface 31 is a tooth surface having 45 degrees. The second locking tooth surface of the gear locking member 4 is a tooth surface having 90 degrees, and the second slidable tooth surface is a tooth surface having 45 degrees. Obviously, the two tooth surfaces having 90 degrees are locked by each other and cannot slide relatively, while the two tooth surfaces having 45 degrees are slidable relative to each other. Of course, the tooth surface having 90 degrees and the tooth surfaces having 45 degrees are merely preferable locking tooth surface and slidable tooth surface respectively. The degrees of the locking tooth surface and slidable tooth surface are not limited herein, and any locking tooth surface and slidable tooth surface fall into the protect scope of the present application as long as the degrees thereof meet the requirements of locking, and being slidable.

In an embodiment of the present application, a rivet 7 is included. A first rivet hole 51 fitting the rivet 7 is arranged in the gear fixing member 5, a second rivet hole 41 fitting the rivet 7 is arranged in the gear locking member 4, and the rivet 7 passes through the first rivet hole 51 and the second rivet hole 41 to realize an axial fixing of the gear fixing member 5 and the gear locking member 4. Of course, the gear fixing member 5 and the gear locking member 4 are rotatable around the rivet 7 at the circumferential direction.

In an embodiment of the present application, a button 8 is further included. The button 8 is configured to press the gear 3, and further drives gear 3 to press the compressed spring 6 to allow the gear 3 to move to be close to the gear fixing member 5. Thus the gear 3 is away from the gear locking member 4, and the locking between the gear 3 and the gear locking member 4 is released, in this way, the gear 3 and the gear locking member 4 are allowed to rotate freely, that is, the second end of the first L-shaped supporting rod 1 and the second end of the second L-shaped supporting rod 2 are not only rotatable to be close to the bed sheet 9 but also are rotatable to be away from the bed sheet 9. FIG. 5 shows the bed sheet 9 in a tightly stretched state. If the folding bed is required to be folded, the button 8 is firstly pressed to release the locking between the gear 3 and the gear locking member 4, then the second end of the first L-shaped supporting rod 1 and the second end of the second L-shaped supporting rod 2 are rotated in a direction away from the bed sheet 9, and thus the distance between the first end of the first L-shaped supporting rod 1 and the first end of the second L-shaped supporting rod 2 becomes smaller, and the bed sheet 9 are loosened, thereby facilitating disassembly of the first side supporting rod 10 and the second side supporting rod 20.

Specifically, the above-mentioned button 8 includes a button surface 81 and a presser foot 82 connected to the button surface 81. The button 8 is exposed at an outside of the gear locking member 4, and the gear locking member 4 is provided with a presser foot hole 42 which is in a clearance fit with the presser foot 82. A bottom of the presser foot 82 is provided with a presser foot protrusion 83 configured to prevent the presser foot 82 from penetrating through the presser foot hole 42. Thus, the connection of the button 8 and the gear locking member 4 is realized.

In an embodiment of the present application, the gear fixing member 5 is provided with a first connecting pipe 53, and the gear locking member 4 is provided with a second connecting pipe 43. One end of the first L-shaped supporting rod 1 is inserted into the first connecting pipe 53, and one end of the second L-shaped supporting rod 2 is inserted into the second connecting pipe 43. As shown in FIG. 8, the first L-shaped supporting rod 1 and the second L-shaped supporting rod 2 are in a folded state. For further decreasing the volume after the folding bed is folded, the second L-shaped supporting rod 2 is rotated by 180 degrees about its own axis in the second connecting pipe 43 and is overlapped with the first L-shaped supporting rod 1. Of course, the first L-shaped supporting rod 1 may also be overlapped with the second L-shaped supporting rod 2.

In an embodiment of the present application, the end portion of the "|" structure of the first L-shaped supporting rod 1 is provided with a first C-shaped clamping element 11, and the end portion of the "|" structure of the second L-shaped supporting rod 2 is provided with a second C-shaped clamping element 21. The first C-shaped clamping element 11 is used to clamp the first side supporting rod 10, and the second L-shaped supporting rod 2 is used to clamp the second side supporting rod 20. It is both convenient and firm to use the C-shaped clamping element to realize a detachable connection and an articulation between the first L-shaped supporting rod 1 and the first side supporting rod 10.

Based on the above description of the above described embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

What is claimed is:

1. A folding bed, comprising:

a bed sheet, a first side supporting rod connected to a first edge of the bed sheet, and a second side supporting rod connected to a second edge of the bed sheet, the first edge being opposite to the second edge, wherein the folding bed further comprises:

a first L-shaped supporting rod having a first end articulated to the first side supporting rod, a second L-shaped supporting rod having a first end articulated to the second side supporting rod, a gear connected to a second end of the first L-shaped supporting rod, and a gear locking member connected to a second end of the second L-shaped supporting rod, wherein the gear locking member has teeth, the teeth of the gear locking member and teeth of the gear are locked by each other when the second end of the first L-shaped supporting rod and the second end of the second L-shaped supporting rod rotate away from the bed sheet, and the teeth of the gear locking member and teeth of the gear slide with respect to each other when the second end of the first L-shaped supporting rod and the second end of the second L-shaped supporting rod rotate to get close to the bed sheet.

2. The folding bed according to claim 1, wherein the folding bed further comprises a gear fixing member, the gear is located in the gear fixing member and is circumferentially fixed with respect to the gear fixing member and axially movable, a compressed spring is arranged between the gear and the gear locking member, the teeth of the gear are arranged on an end surface of the gear and are in a circumferential direction of the gear, and each of the teeth of the gear comprises a first locking tooth surface and a first slidable tooth surface; and the gear locking member and the gear fixing member are axially connected, the teeth of the gear locking member are arranged on an end surface of the gear locking member and are in a circumferential direction of the gear locking member, each of the teeth of the gear locking member comprises a second locking tooth surface which fits and locks the first locking tooth surface, and a second slidable tooth surface which is configured to fit the first slidable tooth surface and is slidable with respect to the first slidable tooth surface.

3. The folding bed according to claim 2, wherein a position-limiting groove is provided in an inner surface of the gear fixing member, and an outer circumferential surface of the gear is provided with a position-limiting protrusion fitting the position-limiting groove.

4. The folding bed according to claim 2, wherein the first locking tooth surface is a tooth surface having 90 degrees, the first slidable tooth surface is a tooth surface having 45 degrees, the second locking tooth surface is a tooth surface having 90 degrees, and the second slidable tooth surface is a tooth surface having 45 degrees.

5. The folding bed according to claim 2, wherein the folding bed further comprises a rivet, a first rivet hole fitting the rivet is arranged on the gear fixing member, and a second rivet hole fitting the rivet is arranged on the gear locking member.

6. The folding bed according to claim 2, wherein the folding bed further comprises a button configured to press the gear toward the gear fixing member to allow the gear to disengage from the gear locking member.

7. The folding bed according to claim 6, wherein the button further comprises:

a button surface located outside the gear locking member, and a presser foot connected to the button surface and configured to press the gear, wherein the gear locking member is provided with a presser foot hole which fits the presser foot, and a bottom of the presser foot is provided with a presser foot protrusion which prevents the presser foot from penetrating through the presser foot hole.

8. The folding bed according to claim 2, wherein the gear fixing member comprises a first connecting pipe, and one end of the first L-shaped supporting rod is inserted into the first connecting pipe.

9. The folding bed according to claim 2, wherein the gear locking member comprises a second connecting pipe, and one end of the second L-shaped supporting rod is inserted into the second connecting pipe.

10. The folding bed according to claim 1, wherein the first end of the first L-shaped supporting rod is provided with a first C-shaped clamping element for clamping the first side supporting rod, and the first end of the second L-shaped supporting rod is provided with a second C-shaped clamping element for clamping the second side supporting rod.

* * * * *